US011724909B2

(12) United States Patent
Sudi et al.

(10) Patent No.: US 11,724,909 B2
(45) Date of Patent: Aug. 15, 2023

(54) ELEVATOR CAR ASSIGNMENT BASED ON A DETECTED NUMBER OF WAITING PASSENGERS

(71) Applicant: OTIS ELEVATOR COMPANY, Farmington, CT (US)

(72) Inventors: Sandeep Sudi, Farmington, CT (US); Robert Costabile, Sarasota, FL (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1106 days.

(21) Appl. No.: 16/387,668

(22) Filed: Apr. 18, 2019

(65) Prior Publication Data

US 2020/0331723 A1 Oct. 22, 2020

(51) Int. Cl.

| | |
|---|---|
| ***B66B 1/34*** | (2006.01) |
| ***B66B 1/46*** | (2006.01) |
| ***B66B 5/00*** | (2006.01) |

(52) U.S. Cl.

CPC ..... *B66B 1/3476* (2013.01); *B66B 1/468* (2013.01); *B66B 5/0012* (2013.01); *B66B 2201/222* (2013.01); *B66B 2201/405* (2013.01); *B66B 2201/4669* (2013.01)

(58) Field of Classification Search

CPC ..... B66B 1/3476; B66B 1/468; B66B 5/0012; B66B 2201/222; B66B 2201/405; B66B 2201/4669; B66B 1/2408; B66B 1/06; B66B 1/3423; B66B 1/3446

See application file for complete search history.

(56) References Cited

U.S. PATENT DOCUMENTS

| | | | |
|---|---|---|---|
| 5,689,094 | A | 11/1997 | Friedli et al. |
| 6,202,799 | B1 | 3/2001 | Drop |
| 6,382,363 | B1 | 5/2002 | Friedli |
| 6,772,862 | B2 | 8/2004 | Friedli |
| 6,801,792 | B1 | 10/2004 | Schuster et al. |
| 6,868,945 | B2 | 3/2005 | Schuster et al. |
| 8,230,979 | B2 | 7/2012 | Finschi et al. |
| 8,387,757 | B2 | 3/2013 | Christy et al. |
| 2016/0368732 | A1 | 12/2016 | Zhao et al. |
| 2018/0237256 | A1* | 8/2018 | Yamada ..... G05B 17/02 |
| 2019/0389688 | A1* | 12/2019 | Stanley ..... B66B 1/28 |
| 2020/0307950 | A1* | 10/2020 | Sudi ..... B66B 1/468 |

FOREIGN PATENT DOCUMENTS

| | | | |
|---|---|---|---|
| EP | 3 106 416 | A1 | 6/2016 |
| EP | 3 076 247 | A1 | 10/2016 |
| EP | 3 228 569 | A1 | 10/2017 |
| JP | 2002-302348 | | 10/2002 |
| WO | 2016/073067 | A1 | 5/2016 |

OTHER PUBLICATIONS

Extended European Search Report for Application No. EP 19218184.0 dated Oct. 5, 2020.

* cited by examiner

*Primary Examiner* — Jeffrey Donels

(74) *Attorney, Agent, or Firm* — Carlson, Gaskey & Olds, P.C.

(57) ABSTRACT

An illustrative example method of controlling an elevator system includes detecting a number of passengers waiting for elevator service at a landing, detecting an available passenger capacity of a plurality of elevator cars, respectively, and assigning at least one of the elevator cars to travel to the landing to provide elevator service to the passengers based on the detected number of passengers and the available passenger capacity of the at least one of the elevator cars.

20 Claims, 2 Drawing Sheets

ELEVATOR CAR ASSIGNMENT BASED ON A DETECTED NUMBER OF WAITING PASSENGERS

BACKGROUND

Elevator systems have proven useful for carrying people among different levels within buildings. Over the years different technologies have been introduced allowing people to place calls or requests for elevator service. Traditional hall call buttons allow an individual to place a call by indicating a desire to be carried up or down from a particular floor. An elevator car travels to that floor in response to the hall call and once on board, the passenger uses a car operating panel to indicate an intended destination. Some more modern systems allow a passenger to place a request for elevator service including the intended destination using an input device that is located outside of the elevator cars. A variety of dispatching algorithms are known for assigning elevator cars to such requests.

One way in which such systems do not meet the expectations of some passengers is that the elevator car assigned to their call may be crowded and may make multiple stops along the way to their intended destination. It would be advantageous to provide improved service to at least certain passengers.

SUMMARY

An illustrative example method of controlling an elevator system includes detecting a number of passengers waiting for elevator service at a landing, detecting an available passenger capacity of a plurality of elevator cars, respectively, and assigning at least one of the elevator cars to travel to the landing to provide elevator service to the passengers based on the detected number of passengers and the available passenger capacity of the at least one of the elevator cars.

An example embodiment having one or more features of the method of the previous paragraph includes determining an intended destination of the passengers that board the at least one of the elevator cars, wherein the intended destination includes at least one floor; and preventing the at least one of the elevator cars from stopping at any floor other than the determined intended destination until all of the passengers exit the at least one of the elevator cars.

In an example embodiment having one or more features of the method of any of the previous paragraphs, detecting the number of passengers waiting for elevator service at the landing comprises using at least one detector situated outside of the elevator cars and detecting the available passenger capacity of the elevator cars comprises using a plurality of detectors respectively situated inside the elevator cars.

In an example embodiment having one or more features of the method of any of the previous paragraphs, the at least one detector situated outside the elevator cars comprises a first camera; the plurality of detectors respectively situated inside the elevator cars each comprise a second camera; detecting the number of passengers is based on image information provided by the first camera; and detecting the available passenger capacity of the respective elevator cars is based on image information provided by the second cameras, respectively.

In an example embodiment having one or more features of the method of any of the previous paragraphs, detecting the available passenger capacity of the elevator cars comprises determining an amount of unoccupied space within the elevator cars, respectively.

An example embodiment having one or more features of the method of any of the previous paragraphs includes determining how many of the passengers board the at least one of the elevator cars from the landing and determining whether any passengers exit the at least one of elevator cars at the landing.

In an example embodiment having one or more features of the method of any of the previous paragraphs, assigning the at least one of the elevator cars comprises assigning only one of the elevator cars when the available passenger capacity of the only one of the elevator cars is at least as large as a capacity needed to accommodate the number of passengers or assigning more than one of the elevator cars when the capacity needed to accommodate the number of passengers is greater than the available passenger capacity of any of the elevator cars.

An example embodiment having one or more features of the method of any of the previous paragraphs includes identifying at least one of the passengers waiting for elevator service and wherein assigning the at least one elevator car is based at least in part on an identity of the identified at least one of the passengers.

In an example embodiment having one or more features of the method of any of the previous paragraphs, assigning the at least one of the elevator cars includes at least one of prioritizing assigning an empty one of the elevator cars over assigning another one of the elevator cars that includes at least one passenger and prioritizing assigning one of the elevator cars to provide the elevator service over assigning the one of the elevator cars to travel to a different landing to provide other elevator service to at least one other passenger.

In an example embodiment having one or more features of the method of any of the previous paragraphs, assigning the at least one of the elevator cars is based on the available passenger capacity of the at least one of the elevator cars being greater than an amount of space required to accommodate the detected number of passengers.

An illustrative example elevator system includes a plurality of elevator cars; at least one detector situated at a landing, the at least one detector being configured to detect a number of passengers waiting for elevator service at the landing; a plurality of car capacity detectors respectively associated with the elevator cars, the car capacity detectors being configured to detect an available passenger capacity of the elevator cars, respectively; and a controller configured to assign at least one of the elevator cars to travel to the landing to provide elevator service to the passengers based on the detected number of passengers and the available passenger capacity of the at least one of the elevator cars.

In an example embodiment having one or more features of the elevator system of the previous paragraph, the controller is configured to determine an intended destination of the passengers that board the at least one of the elevator cars at the landing, wherein the intended destination includes at least one floor; and prevent the at least one of the elevator cars from stopping at any floor other than the determined intended destination until all of the passengers exit the at least one of the elevator cars.

In an example embodiment having one or more features of the elevator system of any of the previous paragraphs, the at least one detector situated at the landing comprises a first camera, the at least one car capacity detector comprises a second camera, the controller uses image information provided by the first camera to determine the number of passengers waiting for elevator service at the landing, and the controller uses image information provided by the second camera to determine the available passenger capacity.

In an example embodiment having one or more features of the elevator system of any of the previous paragraphs, the controller is configured to determine the available passenger capacity of the elevator cars, respectively, by determining an amount of unoccupied space within the elevator cars, respectively.

In an example embodiment having one or more features of the elevator system of any of the previous paragraphs, the controller is configured to determine a number of passengers that board or exit the at least one of the elevator cars at the landing based on information from at least one of the car capacity detector associated with the at least one of the elevator cars and the at least one detector situated at the landing.

In an example embodiment having one or more features of the elevator system of any of the previous paragraphs, the controller is configured to assign only one of the elevator cars when the available passenger capacity of the only one of the elevator cars is at least as large as a capacity needed to accommodate the number of passengers or assign more than one of the elevator cars when the capacity needed to accommodate the number of passengers is greater than the available passenger capacity of any of the elevator cars.

In an example embodiment having one or more features of the elevator system of any of the previous paragraphs, the controller is configured to identify at least one of the passengers waiting for elevator service and assign the at least one of the elevator cars based at least in part on an identity of the identified one of the passengers.

In an example embodiment having one or more features of the elevator system of any of the previous paragraphs, the controller is configured to assign the at least one of the elevator cars by at least one of prioritizing one of the elevator cars that is empty over another one of the elevator cars that includes at least one passenger and prioritizing assigning one of the elevator cars to provide the elevator service over assigning the one of the elevator cars to travel to a different landing to provide other elevator service to at least one other passenger.

In an example embodiment having one or more features of the elevator system of any of the previous paragraphs, the controller is configured to assign a lowest possible number of elevator cars to provide the elevator service to the passengers.

In an example embodiment having one or more features of the elevator system of any of the previous paragraphs, the controller is configured to assign the at least one of the elevator cars based on the available capacity of the at least one of the elevator cars being greater than an amount of space required to accommodate the detected number of passengers.

The various features and advantages of at least one disclosed example embodiment will become apparent to those skilled in the art from the following detailed description. The drawings that accompany the detailed description can be briefly described as follows.

DETAILED DESCRIPTION

Figure 1:
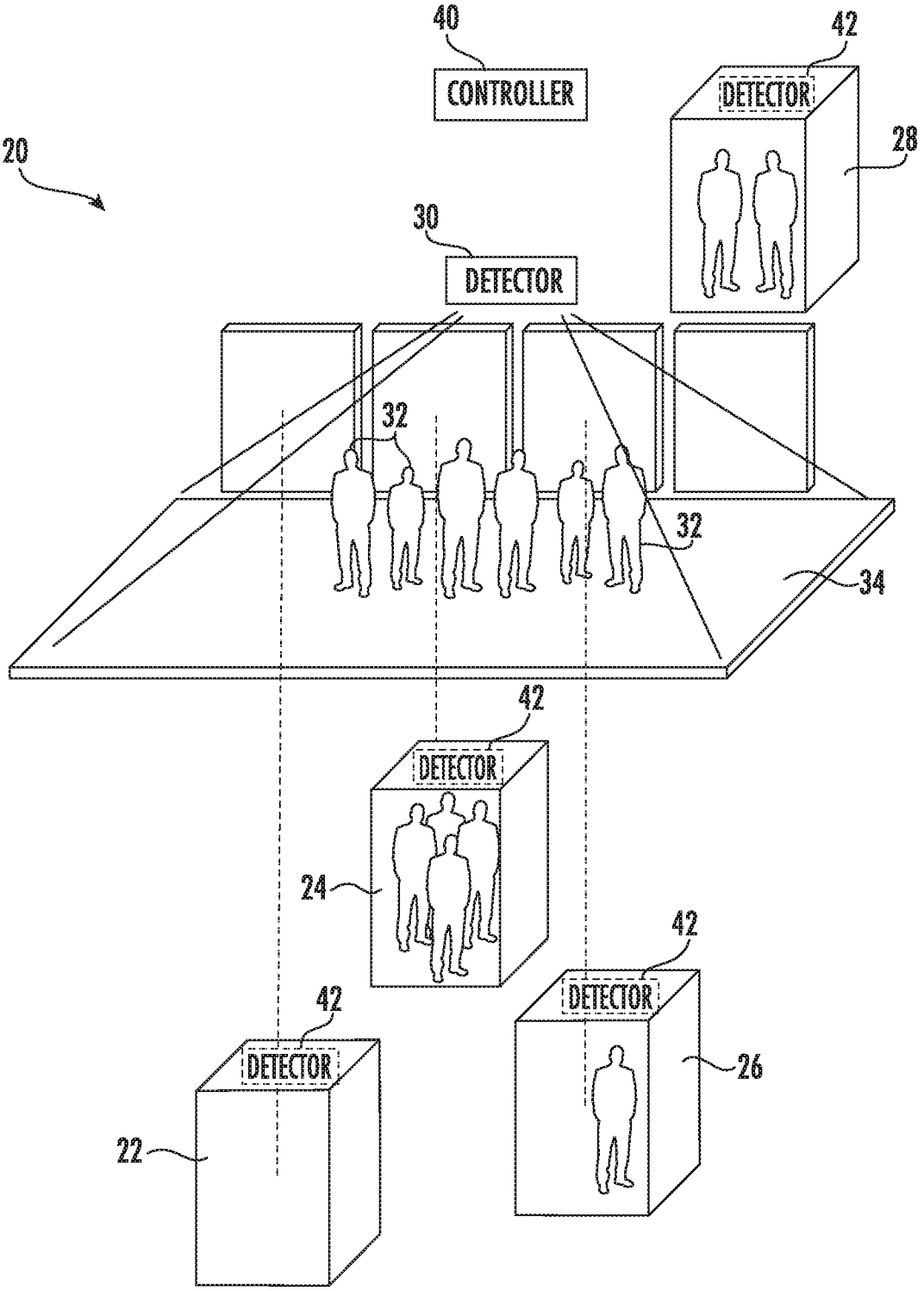
FIG. 1 schematically illustrates selected portions of an example elevator system.

FIG. 1 schematically illustrates selected portions of an example elevator system 20 including a plurality of elevator cars 22, 24, 26 and 28. A detector 30 is configured to detect a number of passengers 32 waiting for elevator service at a landing 34. The detector 30 in an example embodiment comprises a camera. In some embodiments, the detector 30 may be a thermal sensor, a two-dimensional or three-dimensional depth sensor, pressure mats, a radar sensor, or a weight sensor. Those skilled in the art that have the benefit of this description will realize what type of sensor to use for their particular implementation. In some embodiments the detector 30 includes a processor that is configured to process image information from the camera to provide an output indicating the number of passengers 32 waiting for elevator service.

A controller 40 is configured to assign at least one of the elevator cars 22-28 to provide elevator service to the passengers 32. The controller 40 utilizes information regarding an available passenger capacity of the respective elevator cars 22-28 for purposes of determining which car or cars to assign to provide service to the passengers 32. The controller 40 is a computing device dedicated to assigning elevator cars to calls in some embodiments. In others, the controller 40 is part of a device that performs several elevator system control functions.

In FIG. 1, at least one detector 42 is associated with each of the elevator cars 22-28. In an example embodiment, the detectors 42 respectively comprise a camera. In some embodiments, the detectors 42 may be a thermal sensor, a two-dimensional or three-dimensional depth sensor, pressure mats, a radar sensor, or a weight sensor. Those skilled in the art that have the benefit of this description will realize what type of sensor to use for their particular implementation. The controller 40 is configured to process image information from the detectors 42 for determining an available passenger capacity or an unoccupied area within the respective elevator cars 22-28. The controller 40 is configured to assign at least one of the elevator cars 22-28 based upon the detected number of passengers 32 and the available passenger capacity of the elevator cars 22-28, respectively.

Known image processing techniques are used in some example embodiments for determining the number of passengers waiting at the landing 34 and for determining the available passenger capacity within the elevator cars 22-28.

In an example embodiment, the controller 40 is configured to provide a specialized type of elevator service on floors that include a landing 34 with a detector 30 for detecting the number of passengers 32 waiting for elevator service. The specialized type of elevator service can provide premium elevator access to individuals on such floors compared to others where passengers place a call for elevator service by pressing a traditional hall call button.

An example feature of a specialized type of service includes prioritizing assigning empty elevator cars over other cars that have at least one passenger already on board. Assigning empty elevator cars provides an enhanced passenger experience by avoiding a feeling of being crowded in an elevator car and minimizes the number of stops between the landing 34 and the intended destination. Another aspect of specialized service in an example embodiment includes faster dispatching time by assigning elevator cars to provide service to passengers waiting on a floor with a detector 30 before assigning a car to a call placed on another floor. Some example embodiments include minimizing the number of stops of an elevator car carrying the passengers 32 until those passengers reach their intended destination. This example feature reduces the time passengers who receive specialized service spend on an elevator.

Figure 2:
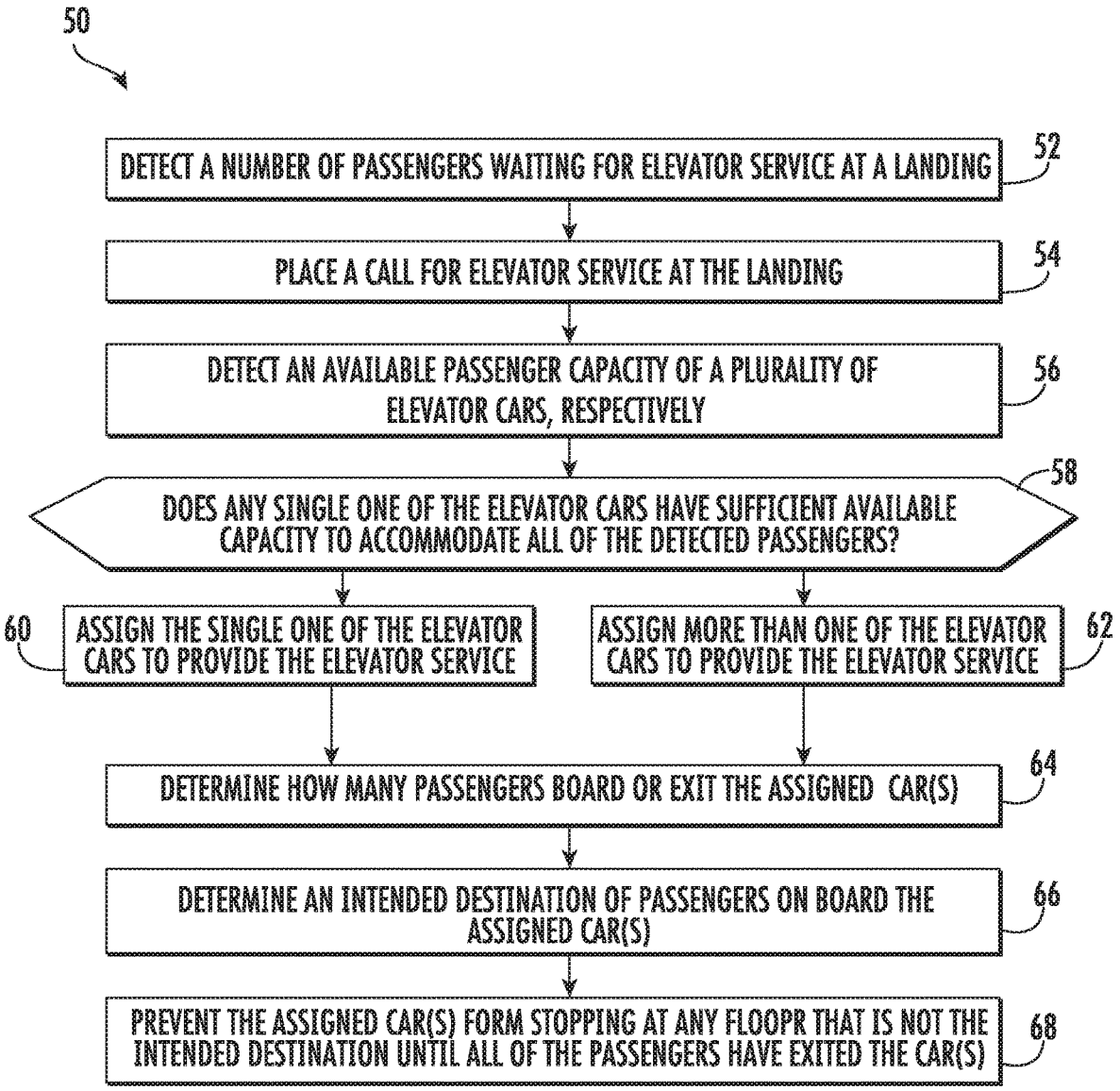
FIG. 2 is a flowchart diagram summarizing an example approach for providing elevator service.

The flowchart diagram 50 of FIG. 2 summarizes an example approach for controlling elevator system operation. At 52, the detector 30 detects at least one passenger 32 waiting for elevator service at the landing 34. The detector 30 communicates information regarding the detected number of passengers or image information to the controller 40. At 54, the controller 40 automatically places a call for elevator service at the landing 54. In some embodiments, a hall call fixture is available for at least one of the passengers 32 to place a call for elevator service. In other embodiments, the detector 30 automatically places a call for elevator service upon detecting at least one passenger waiting at the landing 34.

At 56, the respective detectors 42 detect the available passenger capacity of the corresponding elevator cars 22-28. Each detector 42 provides information to the controller 40 indicating or corresponding to the available passenger capacity in the corresponding car. In this example embodiment, the controller 40 uses available space or area information regarding each of the cars 22-28 to determine the respective available passenger capacities. Using the illustration of FIG. 1 as an example, the elevator car 22 is empty and, therefore, has a maximum possible available passenger capacity. The elevator car 26 already has one passenger on board and, therefore, has somewhat less available passenger capacity compared to the elevator car 22. The elevator cars 28 and 24, respectively, have increased numbers of passengers and have less available passenger capacity under the circumstances schematically illustrated in FIG. 1. The controller 40 in this example embodiment is configured to prioritize assigning empty elevator cars whenever available.

In some embodiments the controller 40 attempts to assign as few of the elevator cars as possible to serve the passengers 32 waiting at the landing 34. This allows such passengers to travel together on the same elevator car when the number of passengers waiting at the landing 34 can comfortably fit within a single car. If more than one car is needed, a reduced or minimized number of assigned cars allows the waiting passengers to board one of the assigned cars at the same time or at least reduces the amount of time one passenger remains waiting after another has boarded a car and left the landing 34.

At 58 in FIG. 2, the controller 40 determines whether any single one of the elevator cars 22-28 has sufficient available capacity to accommodate all of the detected passengers 32. In FIG. 1, the elevator cars 22 and 26 each have available passenger capacity that is at least as large as the capacity needed to accommodate the number of passengers 32 detected by the detector 30. Under such circumstances, the controller 40 assigns one of the elevators cars 22 or 26 to provide elevator service to the passengers 32. In an embodiment where an empty elevator car is prioritized as a first choice, the elevator car 22 would be assigned by the controller 40. In an embodiment where the fastest dispatch time is considered important, the controller 40 will determine which of the elevator cars 22 or 26 will be able to arrive at the landing 34 first.

Assuming none of the elevator cars 22-28 by itself has enough capacity to accommodate all of the passengers 32, the controller 40 assigns more than one of the elevator cars to provide the elevator service at 62 in FIG. 2. Such an assignment may include prioritizing empty elevator cars or fastest dispatch time, or both. In some embodiments, the controller 40 is configured to prefer the fewest number of elevator cars possible and the assignment at 60 would be made whenever possible instead of the assignment at 62.

In some embodiments, when there is no single car capable of accommodating all of the passengers 32 waiting at the landing 34, the controller 40 may cause more than one of the elevator cars to arrive at the landing 34. In some embodiments, the car doors are controlled so that all of the assigned cars become available to the passengers 32 at the same time even if the cars arrive at different times. Controlling the doors in this way allows all of the passengers 32 to leave the landing 34 together.

Once the assigned elevator car (or cars) arrives at the landing 34, the controller 40 determines how many passengers 32 board the assigned car based on updates of information from the detector 30, updated information from the detector 42 of the assigned car, or both. At 64, the controller 40 dynamically updates the passenger count for keeping track of changes in the available passenger capacity of the elevators cars.

Once the passengers 32 are on board the assigned car or cars, the controller 40 determines the intended destination of the passengers at 66. The intended destination may be a single floor that all of the passengers 32 on board the assigned elevator car intend to reach. Under some scenarios, different passengers will have different desired or intended destinations. At 68, the controller 40 controls movement of the assigned car and future assignments of that car to prevent that car from stopping at any floor that is not the intended destination of at least one of the passengers 32 on board that car until all of the passengers 32 have exited that car. By preventing any new hall calls from being assigned to that car, the passengers 32 experience premium service because they do not have to stop at any floor that is not an intended destination of at least one of those passengers. For situations where all of the passengers 32 intend to travel from the landing 34 to a single destination, the passenger experience and elevator system efficiency tend to be maximized.

Some embodiments include identifying at least one of the passengers 32 waiting for elevator service. Passengers may be identified based on detecting a portable credential device, such as a smart card or RFID chip, carried by one or more of them. In some embodiments, the detector 30 obtains visual image information and known facial recognition techniques allow for identifying a waiting passenger. Assigning an elevator car in such an embodiment can be based at least in part on the identity of the identified passenger or passengers. For example, some passengers may have special accommodation requirements or may be provided special service, such as always having an empty elevator car arrive to pick them up.

Assigning at least one of the elevator cars based on the available capacity and an amount of space required to accommodate the detected number of passengers facilitates providing enhanced elevator service for such passengers. When the car assignment is based on the available passenger capacity being greater than an amount of space required to accommodate the detected number of passengers, those passengers will not feel crowded within the elevator car.

The preceding description is illustrative rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of controlling an elevator system including a plurality of elevator cars, the method comprising:

detecting a number of passengers waiting for elevator service at a landing;

detecting an available passenger capacity of the elevator cars, respectively; and assigning at least one of the elevator cars to travel to the landing to provide elevator service to the passengers based on the detected number of passengers and the available passenger capacity of the at least one of the elevator cars, wherein assigning the at least one of the elevator cars comprises assigning only one of the elevator cars when the available passenger capacity of the only one of the elevator cars is at least as large as a capacity needed to accommodate the number of passengers; or assigning more than one of the elevator cars when the capacity needed to accommodate the number of passengers is greater than the available passenger capacity of any of the elevator cars.

2. The method of claim 1, comprising determining an intended destination of the passengers that board the at least one of the elevator cars, wherein the intended destination includes at least one floor; and preventing the at least one of the elevator cars from stopping at any floor other than the determined intended destination until all of the passengers exit the at least one of the elevator cars.

3. The method of claim 1, wherein detecting the number of passengers waiting for elevator service at the landing comprises using at least one detector situated outside of the elevator cars; and detecting the available passenger capacity of the elevator cars comprises using a plurality of detectors respectively situated inside the elevator cars.

4. The method of claim 3, wherein the at least one detector situated outside the elevator cars comprises a first camera;

the plurality of detectors respectively situated inside the elevator cars each comprise a second camera;

detecting the number of passengers is based on image information provided by the first camera; and detecting the available passenger capacity of the respective elevator cars is based on image information provided by the second cameras, respectively.

5. The method of claim 4, wherein detecting the available passenger capacity of the elevator cars comprises determining an amount of unoccupied space within the elevator cars, respectively.

6. The method of claim 1, comprising determining how many of the passengers board the at least one of the elevator cars from the landing; and determining whether any passengers exit the at least one of elevator cars at the landing.

7. The method of claim 1, comprising identifying at least one of the passengers waiting for elevator service and wherein assigning the at least one elevator car is based at least in part on an identity of the identified at least one of the passengers.

8. The method of claim 1, wherein assigning the at least one of the elevator cars includes at least one of prioritizing assigning an empty one of the elevator cars over assigning another one of the elevator cars that includes at least one passenger; and prioritizing assigning one of the elevator cars to provide the elevator service over assigning the one of the elevator cars to travel to a different landing to provide other elevator service to at least one other passenger.

9. The method of claim 1, wherein assigning the at least one of the elevator cars is based on the available passenger capacity of the at least one of the elevator cars being greater than an amount of space required to accommodate the detected number of passengers.

10. An elevator system, comprising:

a plurality of elevator cars;

at least one detector situated at a landing, the at least one detector being configured to detect a number of passengers waiting for elevator service at the landing;

a plurality of car capacity detectors respectively associated with the elevator cars, the car capacity detectors being configured to detect an available passenger capacity of the elevator cars, respectively; and a controller configured to assign at least one of the elevator cars to travel to the landing to provide elevator service to the passengers based on the detected number of passengers and the available passenger capacity of the at least one of the elevator cars, wherein the controller is configured to assign only one of the elevator cars when the available passenger capacity of the only one of the elevator cars is at least as large as a capacity needed to accommodate the number of passengers; or assign more than one of the elevator cars when the capacity needed to accommodate the number of passengers is greater than the available passenger capacity of any of the elevator cars.

11. The elevator system of claim 10, wherein the controller is configured to determine an intended destination of the passengers that board the at least one of the elevator cars at the landing, wherein the intended destination includes at least one floor; and prevent the at least one of the elevator cars from stopping at any floor other than the determined intended destination until all of the passengers exit the at least one of the elevator cars.

12. The elevator system of claim 10, wherein the at least one detector situated at the landing comprises a first camera;

the plurality of car capacity detectors comprises a second camera;

the controller uses image information provided by the first camera to determine the number of passengers waiting for elevator service at the landing; and the controller uses image information provided by the second camera to determine the available passenger capacity.

13. The elevator system of claim 12, wherein the controller is configured to determine the available passenger capacity of the elevator cars, respectively, by determining an amount of unoccupied space within the elevator cars, respectively.

14. The elevator system of claim 10, wherein the controller is configured to determine a number of passengers that board or exit the at least one of the elevator cars at the landing based on information from at least one of the car capacity detector associated with the at least one of the elevator cars and the at least one detector situated at the landing.

15. The elevator system of claim 10, wherein the controller is configured to identify at least one of the passengers waiting for elevator service; and assign the at least one of the elevator cars based at least in part on an identity of the identified one of the passengers.

16. The elevator system of claim 10, wherein the controller is configured to assign the at least one of the elevator cars by at least one of prioritizing one of the elevator cars that is empty over another one of the elevator cars that includes at least one passenger; and prioritizing assigning one of the elevator cars to provide the elevator service over assigning the one of the elevator cars to travel to a different landing to provide other elevator service to at least one other passenger.

17. The elevator system of claim 16, wherein the controller is configured to assign a lowest possible number of elevator cars to provide the elevator service to the passengers.

18. The elevator system of claim 10, wherein the controller is configured to assign the at least one of the elevator cars based on the available capacity of the at least one of the elevator cars being greater than an amount of space required to accommodate the detected number of passengers.

19. An elevator system, comprising:

a plurality of elevator cars;

at least one detector situated at a landing, the at least one detector being configured to detect a number of passengers waiting for elevator service at the landing;

a plurality of car capacity detectors respectively associated with the elevator cars, the car capacity detectors being configured to detect an available passenger capacity of the elevator cars, respectively; and a controller configured to assign at least one of the elevator cars to travel to the landing to provide elevator service to the passengers based on the detected number of passengers and the available passenger capacity of the at least one of the elevator cars, wherein the controller is configured to determine an intended destination of the passengers that board the at least one of the elevator cars at the landing, wherein the intended destination includes at least one floor; and prevent the at least one of the elevator cars from stopping at any floor other than the determined intended destination until all of the passengers exit the at least one of the elevator cars.

20. A method of controlling an elevator system including a plurality of elevator cars, the method comprising:

detecting a number of passengers waiting for elevator service at a landing;

detecting an available passenger capacity of the elevator cars, respectively; and assigning at least one of the elevator cars to travel to the landing to provide elevator service to the passengers based on the detected number of passengers and the available passenger capacity of the at least one of the elevator cars, wherein assigning the at least one of the elevator cars is based on the available passenger capacity of the at least one of the elevator cars being greater than an amount of space required to accommodate the detected number of passengers.

* * * * *